US006450418B1

(12) United States Patent
Simpson et al.

(10) Patent No.: US 6,450,418 B1
(45) Date of Patent: Sep. 17, 2002

(54) POOL/SPA WATERFALL APPARATUS WITH AN INTERCHANGEABLE OUTLET CAP

(75) Inventors: Rich F. Simpson, Camarillo; Francisco Hinojosa, Jr., Santa Paula, both of CA (US)

(73) Assignee: Waterway Plastics, Inc., Oxnard, CA (US)

( * ) Notice: Subject to any disclaimer, the term of this patent is extended or adjusted under 35 U.S.C. 154(b) by 0 days.

(21) Appl. No.: 09/595,449

(22) Filed: Jun. 16, 2000

(51) Int. Cl.[7] ..... B05B 17/08

(52) U.S. Cl. ..... 239/17; 239/16; 239/19; 239/20; 239/22; 239/23; 239/193; 239/390; 239/391; 239/590; 239/596; 239/597; 4/507

(58) Field of Search ..... 239/16, 17, 19, 239/20, 22, 23, 193, 390, 391, 552, 553, 553.3, 553.5, 590, 590.3, 590.5, 596, 597; 4/678, 507, 509, 541.1, 541.3, 508, 510, 512; D24/200, 201, 202, 203, 204, 205

(56) References Cited

U.S. PATENT DOCUMENTS

| | | | | | |
|---|---|---|---|---|---|
| 1,651,887 | A | * | 12/1927 | Hawes | 239/390 X |
| 3,292,861 | A | * | 12/1966 | Kawamura et al. | 239/17 |
| 4,881,280 | A | | 11/1989 | Lesikar | 4/507 |
| 5,115,974 | A | * | 5/1992 | Tobias et al. | 239/23 |
| 5,201,857 | A | * | 4/1993 | Nix | 4/492 |
| 5,249,744 | A | | 10/1993 | Ruthenberg | 239/23 |
| 5,271,561 | A | * | 12/1993 | Tobias et al. | 239/391 X |
| 5,388,285 | A | * | 2/1995 | Belniak | 4/507 |
| 5,510,022 | A | * | 4/1996 | Mullis | 239/20 |
| 5,537,696 | A | | 7/1996 | Chartier | 4/507 |
| 5,881,401 | A | * | 3/1999 | Saputo | 239/390 X |
| 6,170,094 | B1 | * | 1/2001 | Weise et al. | 4/507 |

OTHER PUBLICATIONS

Sheer Descent®, State of the Art Waterfalls, *Back Feed System, Installation Manuel*, p. 1–15, (1996) Jandy® Industries.

* cited by examiner

*Primary Examiner*—Robin O. Evans
(74) *Attorney, Agent, or Firm*—Koppel, Jacobs, Patrick & Heybl

(57) ABSTRACT

The present invention provides a new waterfall apparatus water reservoirs such as pools, spa's and the like. It comprises a manifold having a water inlet connected to the a water supply, preferably the water supply from the reservoir's plumbing. The manifold has internal baffles to remove turbulence from the water, which is then directed to a spillway water outlet. The spillway has a through slot that allows water to flow out from the manifold. It also has a removable outlet cap which forms the water into a particular waterfall shape. Another embodiment of the invention for spas, has a tubular body and a outlet that is in the form of a longitudinal slot in the body. The outlet cap is then mounted in the slot. In both embodiments the outlet cap can be easily removed to clean the apparatus if debris becomes lodged within it. It can also be removed if the spillway becomes damaged or it the pool/spa owner would like to change the type of waterfall produced by the apparatus.

18 Claims, 8 Drawing Sheets

POOL/SPA WATERFALL APPARATUS WITH AN INTERCHANGEABLE OUTLET CAP

BACKGROUND OF THE INVENTION

1. Field of the Invention

This invention relates to an apparatus for producing waterfalls in pools, spas, tubs, and the like.

2. Description of the Related Art

Reservoirs of water such as pools, spas, and tubs can be constructed with one or more waterfalls running from the reservoir's edge to the surface of the water below. The waterfall is visually appealing and provides a soothing sound. Conventional waterfall apparatus are connected to the water supply from the reservoir's plumbing and have internal structures that convert the relatively turbulent water from the plumbing into a smooth laminar flow appropriate for a waterfall.

U.S. Pat. No. 4,881,280 to Lesikar discloses a pool waterfall unit that is mounted on the pool's edge and produces a smooth sheet of water which is directed away from the side of the pool to the water below. The unit has an interior baffle for directing the turbulent plumbing water evenly out of the unit. When installed, most of the unit is hidden behind the edge of the pool where it is connected to the pool plumbing and the only visible portion is the unit's horizontal spillway.

U.S. Pat. No. 5,249,744 to Ruthenberg also discloses a waterfall apparatus for swimming pools. A natural waterfall is simulated by introducing water into an inlet box that includes a spreader for dividing the incoming stream into two laterally flowing streams. They are reflected off the side walls of the inlet box and collide against each other to suppress the turbulence of the incoming stream. The inlet box has an outlet to create the waterfall, with most of the unit hidden behind the pool's edge.

U.S. Pat. No. 5,537,696 to Chartier, discloses a self contained waterfall module installed in the sidewalls or decks of a pool. It is connected to the pool's plumbing system and has an apertured conduit for introducing water from the plumbing system into the unit. The conduit also converts the turbulent water supply to water appropriate for a laminar sheet waterfall. The unit has a short compact emitter with the conduit transversing the relatively large manifold chamber.

Jandy® Industries also produces a series of pool and spa waterfall apparatus called Sheer Descent® Falls. The waterfalls can take the form of rain, curtain, or arc, depending on the chosen model. The waterfalls have a horizontal opening that ranges from eight inches to eight feet in width and the water can fall up to three feet with a minimal disruption of the waterfall. The apparatus have a water inlet for attaching to a pool/spa's plumbing system and have internal baffles to remove most of the incoming water's turbulence.

One disadvantage of conventional waterfall apparatus is that they are provided as a complete, sealed unit. Each apparatus can only produce one type of waterfall, such as rain, curtain, arc, etc. Once installed, the type of waterfall can only be changed by removing and replacing the entire apparatus. In most instances, the same waterfall will be provided through the life of the unit (or the pool), providing the same visual and auditory impact. This can become monotonous and result in boredom for the pool owner/occupants.

Another disadvantage is that debris can be introduced into the apparatus during use, permanently disrupting the waterfall flow. During installation of the pool's plumbing system and waterfall apparatus, care must be taken to prevent rocks and other debris from entering the system. Debris that does enter the system can be fed into the apparatus, disrupting the uniform flow of the waterfall. Sheer Descent® Falls provides the additional precaution of a rock trap that can be installed in the pool's plumbing to trap rocks and other debris before it enters the apparatus.

Despite these precautions, debris often enters the apparatus and, once inside, it is very difficult to remove. One method recommended by Sheer Descent® Falls is to use a credit card or similar object and generally position it inside the outlet opening while the waterfall is on. The device is then slid along the opening to the point where the debris is located. The debris is then pulled through the opening. However, if the debris is too large to exit the outlet opening, it will be stuck within the unit and permanently disrupt the waterfall.

Conventional waterfall apparatus can also suffer damage to their outlet during or after installation, which can also disrupt the uniform or laminar look of the waterfall. Sheer Descent® Falls provides a protective tongue for the outlet to protect it during installation, but this measure does not protect it during use. If the outlet opening is damaged, the apparatus must be repaired at its installed location, or the entire apparatus must be removed from the pool and plumbing system. Both of these procedures are difficult, costly and time consuming, and it is unlikely that they could be completed by the average pool owner.

SUMMARY OF THE INVENTION

The present invention provides an improved pool/spa waterfall apparatus having a cap on its outlet that can be removed and replaced. The type of cap determines the type of waterfall emitted by the apparatus. This allows the new waterfall unit to produce different types of waterfalls by using different types of outlet caps. In the event that debris is caught in the apparatus or its outlet, it is easily cleaned by simply removing the outlet cap, removing the debris, and replacing the cap. If the outlet cap is damaged during or after installation, it can be quickly and easily replaced by the pool owner.

In one embodiment, the new waterfall apparatus consists primarily of a rectangular shaped and elongated manifold body having a water inlet for connection to the pool/spa's plumbing system. When the system water enters the unit it is relatively turbulent. To remove most of this turbulence, the apparatus has two internal baffles that the water passes as it fills the manifold body. The apparatus also has an outlet that provides a path for water out of the manifold. In one embodiment, the outlet comprises a slender horizontal spillway extending from and running along the top edge of the apparatus, opposite the inlet. The spillway has a through slot running down it's longitudinal centerline providing a passageway for the water to flow from the manifold. An outlet cap is mounted on the end of the spillway to form the water into a waterfall. Depending on the spillway cap used, different types of waterfalls can be formed, including a clear laminar sheet, rain drops, arc, fountain, double arc, pulsating, or any combination thereof. The waterfall apparatus can also include lighting to illuminate the waterfall. The outlet cap can be removed and pulled out of the spillway, and later replaced.

Another embodiment of the invention is particularly applicable to producing waterfalls in spas. It comprises a tubular shaped manifold body with a water inlet directed down to receive water from the spa's plumbing system. The water turbulence is removed by two internal baffles that the water passes as it enters the body. The body's outlet is in the form of a longitudinal slot. An outlet cap is mounted within the slot, such as by screws. As the body fills, water spills from the body through the outlet cap in the form a waterfall. The type of waterfall is dependent upon the type of outlet cap which can be easily removed and replaced.

These and other further features and advantages of the invention will be apparent to those skilled in the art from the following detailed description, taken together with the accompanying drawings, in which:

DETAILED DESCRIPTION OF THE INVENTION

A new waterfall apparatus constructed in accordance with the invention is shown in FIGS. 1–4. Most of its components are formed from a water impervious plastic such as ABS. It is particularly adapted to be positioned at the edge of a reservoir of water such as a pool, spa, and the like. It is connected to the water supply in the reservoir's plumbing, and the waterfall emitting from its outlet falls to the surface of the water within the reservoir.

Figure 1:
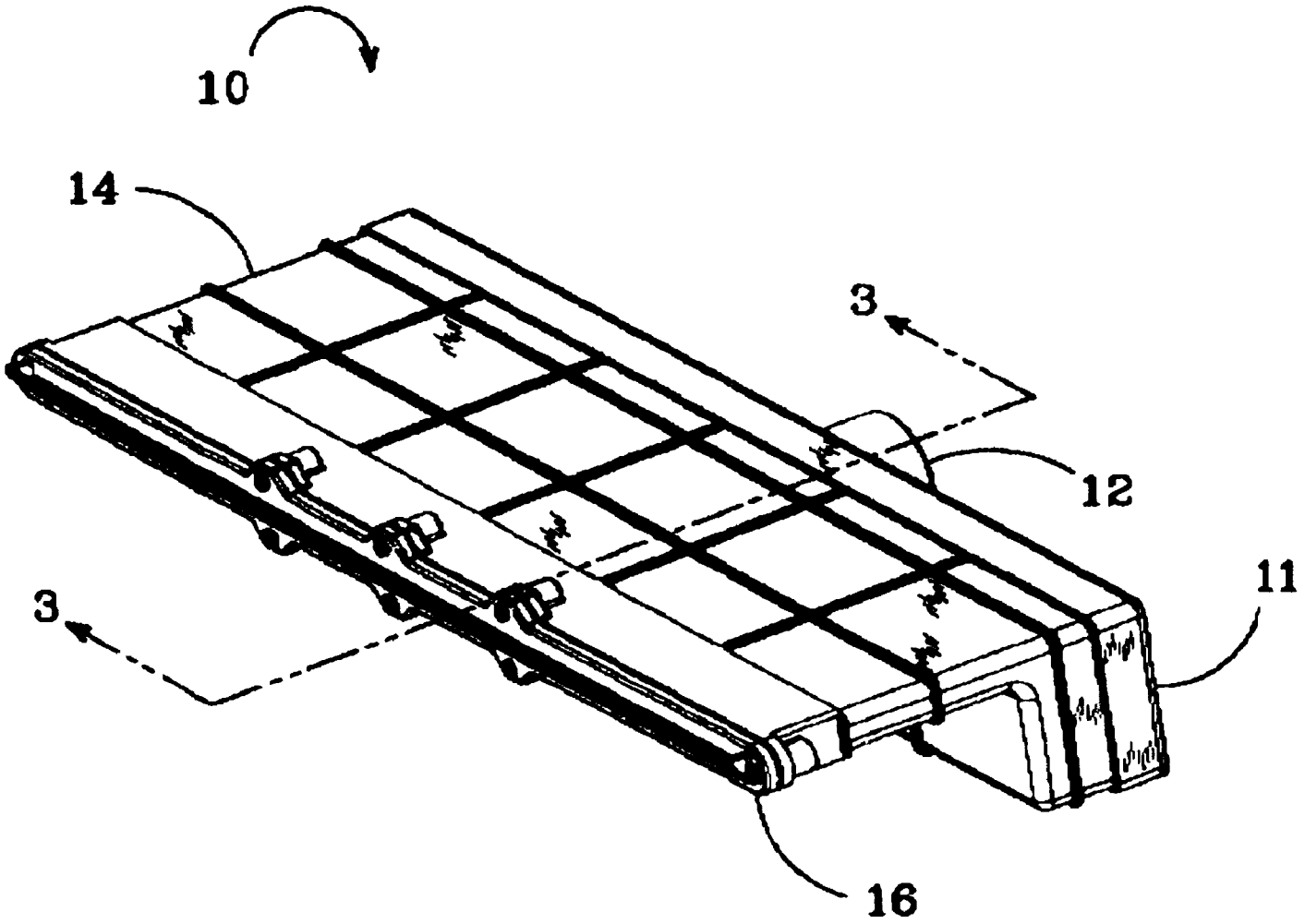
FIG. 1 is a perspective view of one embodiment of the new waterfall apparatus.

As shown in FIG. 1, the new waterfall apparatus 10 includes an elongated manifold 11 having a water inlet 12 to receive a standard water supply from a pool/spa plumbing system. The water enters the manifold 11 through the inlet and fills the manifold with water. An outlet in the form of a slender spillway 14 is preferably formed integrally with the upper portion of the manifold 11, which supplies it with water. The upper walls of the spillway 14 and manifold 11 are preferably continuous.

The spillway 14 has a through slot 29 (shown in FIG. 2) running substantially its entire length. The slot passes through to the manifold 11 and provides a path for water to flow from the manifold 11. A removable outlet cap 16 is mounted on the end of the spillway 14 and forms water flowing through the outlet into a particular type of waterfall. Some of the different waterfall types include laminar sheet, rain drops, arc, pulsating, fountain, double arc, or any combination thereof.

Figure 2:
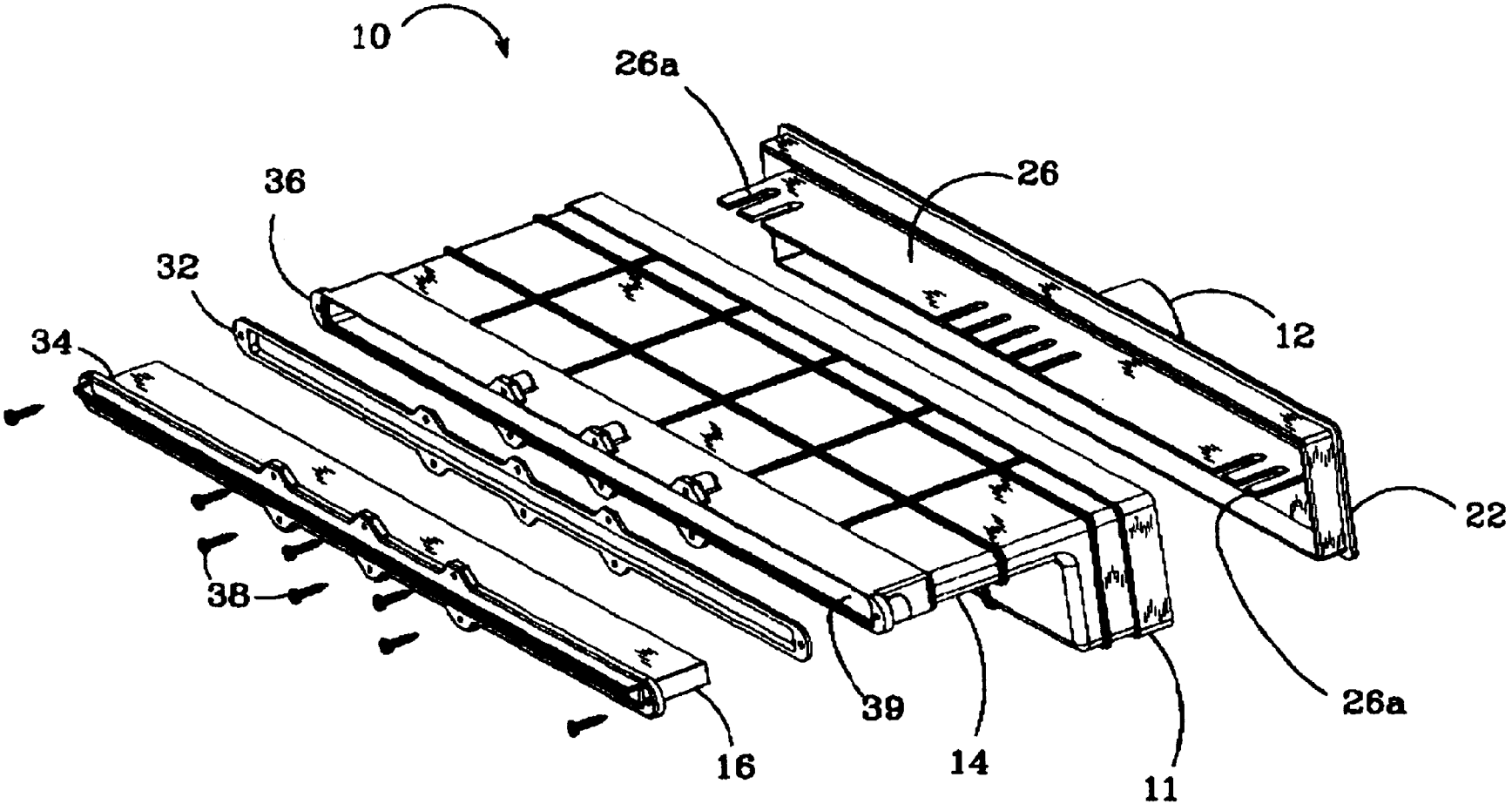
FIG. 2 is a perspective exploded view of the apparatus show in FIG. 1.

FIG. 2 is an exploded view of the apparatus 10 showing its separate components. The manifold 11 has an open back and a back plate 22 is affixed within the opening with a water tight seal. The back plate 22 carries the water inlet 12 and also a baffle 26 that extends internally into the manifold 11 when the back plate 22 is installed. Water entering the manifold 11 from the plumbing system is relatively turbulent; to provide a uniform or laminar waterfall, most of the turbulence should be removed. The baffle 26 is positioned horizontally within the manifold 11 such that water passed the baffle 26 as the manifold 11 is filled. The baffle 26 has several series of slots 26*a* in the direction of water flow, which help to remove much of the turbulence as the water passes. The manifold 11 also includes a second horizontal baffle 41 (shown in FIG. 3) that cooperates with the first baffle to remove much of the remaining water turbulence.

After the water passes the baffles, it enters the slot 29 in the spillway 14, passes through the outlet cap 16, and falls to the water surface below in the form of a waterfall. The cap 16 fits within the spillway slot 29 and has a sealing gasket 32 that is seated between the cap's lip 34 in the end surface 36 of the spillway 14. Screws 38 mount the cap to the spillway with each screw passing through a respective cap hole 39 and gasket hole 38a and screwed into a respective threaded hole 40 around the perimeter of the spillway 14; tabs are provided around the peripheries of the cap, gasket and spillway to provide space for their holes. The screws 38 are turned until snug, compressing the gasket between the cap lip 34 and spillway edge 36 to provide a water tight seal between the two.

Figure 3:
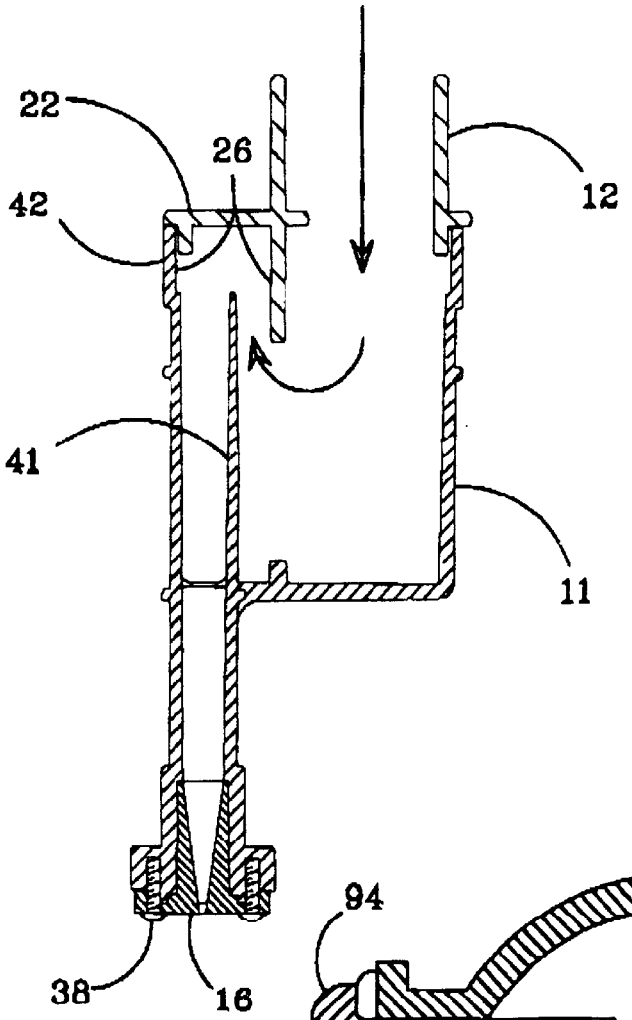
FIG. 3 is a sectional view of the apparatus shown in FIG. 1, taken along section lines 3—3.

Referring now to FIG. 3, the water inlet 12 is connected to the pool/spa plumbing system by seating a water supply PVC pipe (not shown) within the inlet, preferably with an adhesive that provides a secure water tight seal. As described above, water flowing into the apparatus fills the manifold 11 and encounters the baffle 26, which removes much of the its turbulence. In this embodiment, the baffle 26 terminates short of the manifold's front wall, leaving space for water to flow around the inner end of the baffle. However, if desired the baffle 26 could be extended so that its end reaches the manifold's front wall, forcing the water to pass through the slots 26*a* and thereby remove much of its turbulence.

After the water passes baffle 26 it is directed back towards the rear of the manifold by the baffle 41, which is preferably formed as a rearward extension of the lower wall of spillway 14, with its rearward end overlapping and spaced somewhat above the forward end of baffle 26. The water flows in a serpentine path around the forward end of baffle 26 and the rearward end of baffle 41 and the back plate's inner surface 42, to reach the spillway 14. This serpentine fashion path through the manifold 11 removes most of the water turbulence. The water flowing in the spillway has a uniform flow that is suitable for producing a waterfall. Other embodiments of the invention can have one baffle or more than two baffles arranged to remove turbulence from the water.

Figure 4A:
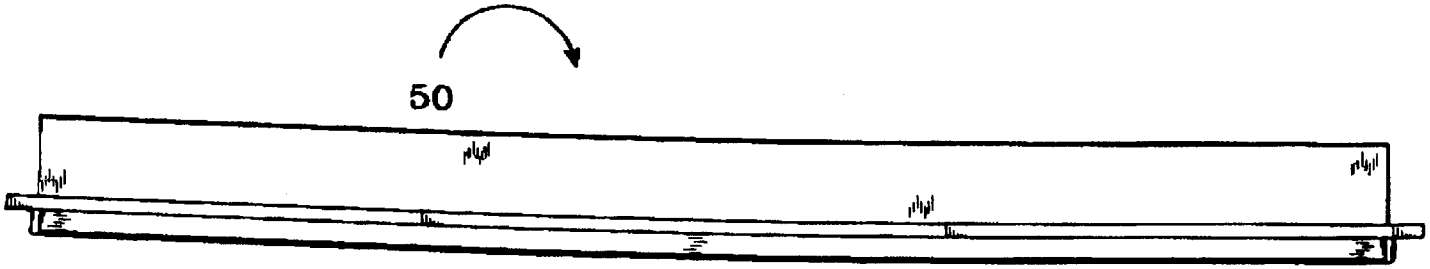
FIG. 4*a* is a plan view of a spillway cap that provides a clear laminar sheet waterfall.
Figure 4B:
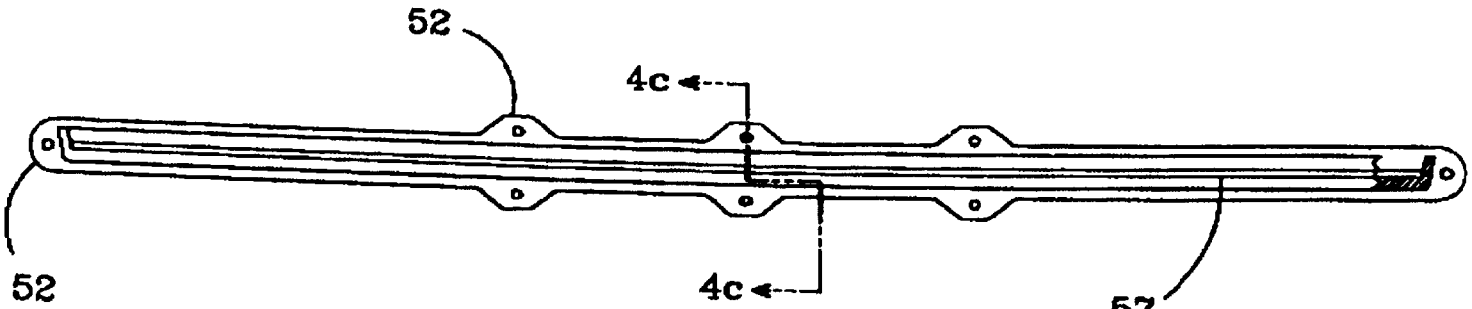
FIG. 4*b* is an elevation view of the spillway cap shown in FIG. 4*a;*
Figure 4C:
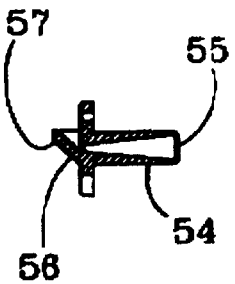
FIG. 4*c* is a sectional view of the spillway cap shown in FIG. 4*b*, taken along section lines 4*c*—4*c;*

FIGS. 4*a* through 4*c* show one embodiment of the new spillway cap 50 that produces a clear laminar sheet waterfall from the water flowing in the spillway 14. It has eight holes 52 in the tabs around its perimeter for screws to pass through and fasten the cap to the threaded holes in the end of the spillway. A slot 54 extends substantially along its full width. At the cap's rear 55, the slot 54 has substantially the same height and width as the spillway slot 29 (See FIG. 2), allowing water to flow freely from the spillway to the slot 54. It then tapers toward the cap's front 56 such that it is narrowest at its front. The cap 50 also has a longitudinal ramp 57 on its front and that extends from immediately below the slot 54, and is directed up and out from the cap's front surface such that said water flowing from the cap 50 flows up an over the ramp. This provides a spacing between the waterfall and the cap's front surface that prevents the front surface from interfering with the laminar sheet of water.

Figure 5A:
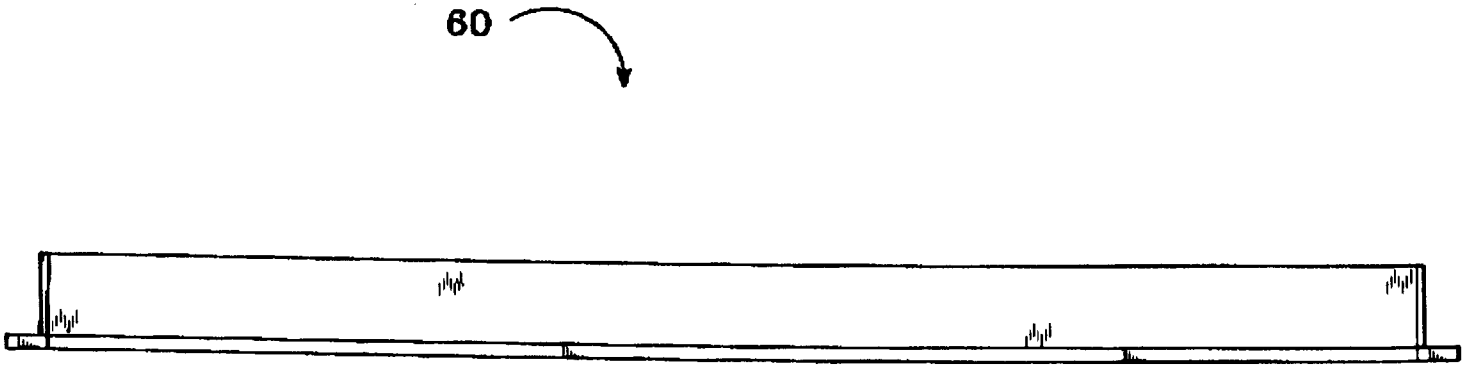
FIG. 5*a* is a plan view of a spillway cap that provides a raindrop waterfall.
Figure 5B:
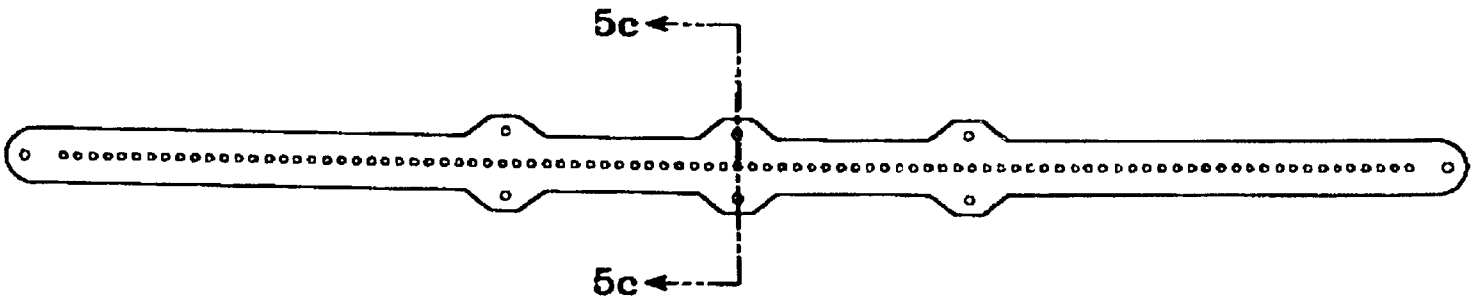
FIG. 5*b* is an elevation view of the spillway cap shown in FIG. 5*a;*
Figure 5C:
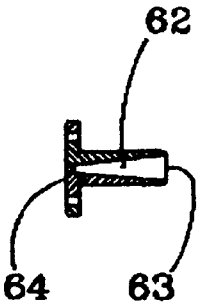
FIG. 5*c* is a sectional view of the spillway cap shown in FIG. 5*b* taken along section lines 5*c*—5*c;*

FIGS. 5*a* through 5*c* show another embodiment 60 of a spillway cap which is designed to provide a raindrop waterfall. This embodiment also has a longitudinal through slot 62 that is the same height as the spillway slot 29 at its rear 63, and tapers toward its front end 64. However, at the cap's front end 64, there are series of holes 65 instead of a continuous slot. The water passes from the slot 62 through the holes 65, with each of the holes establishing a flow of water drops. The cap 60 is fastened to the spillway in the same fashion as the embodiment shown in FIGS. 5*a* through 5*c*.

Figure 6A:
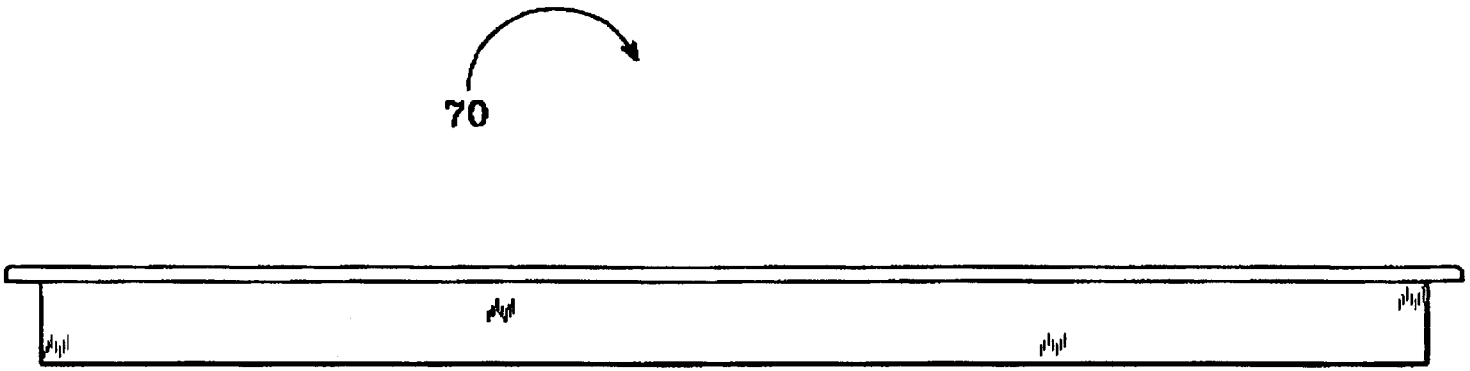
FIG. 6*a* is a plan view of the plug spillway cap.
Figure 6B:
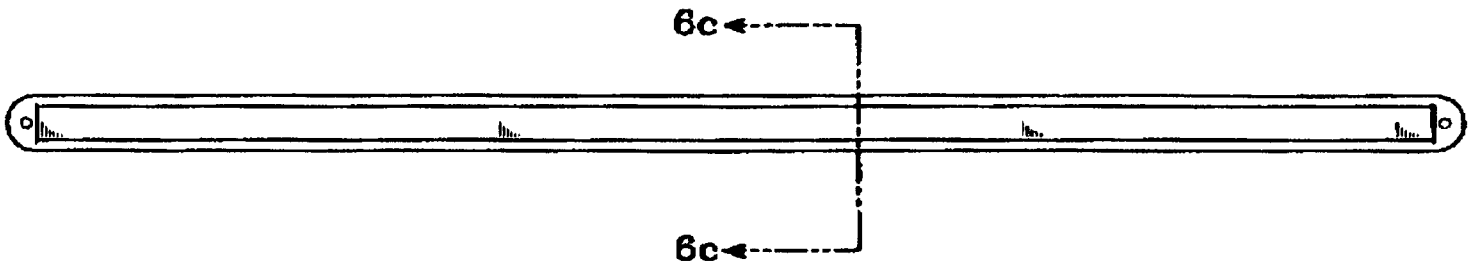
FIG. 6*b* is an elevation view of the spillway cap shown in FIG. 6*a;*
Figure 6C:
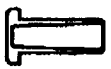
FIG. 6*c* is a sectional view of the spillway cap shown in 6*b* taken along section lines 6*c*—6*c;*

FIGS. 6*a* through 6*c* show another embodiment of the spillway cap 70 that can be used to both plug the spillway 14 or to protect the spillway's edge. It is also mounted to the end of the spillway by screws. The front end of the cap is closed, blocking the water flow from the spillway 14 and also protecting the end of the spillway 14.

Figure 9:
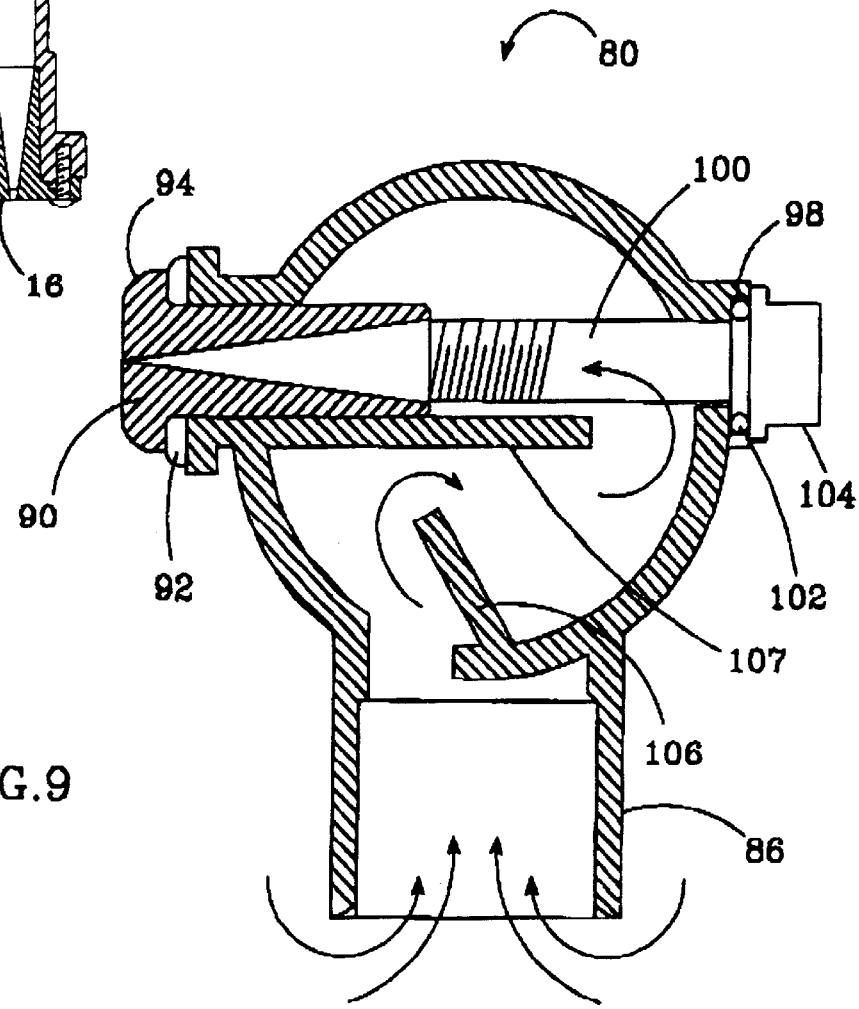
FIG. 9 is a sectional view of the apparatus shown in FIG. 7 taken along section lines 9—9.
Figure 7:
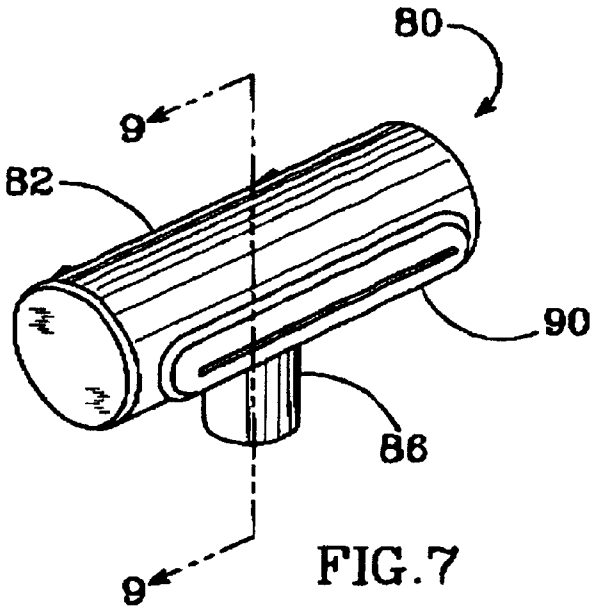
FIG. 7 is a perspective view of a waterfall apparatus particularly applicable to spas.
Figure 8:
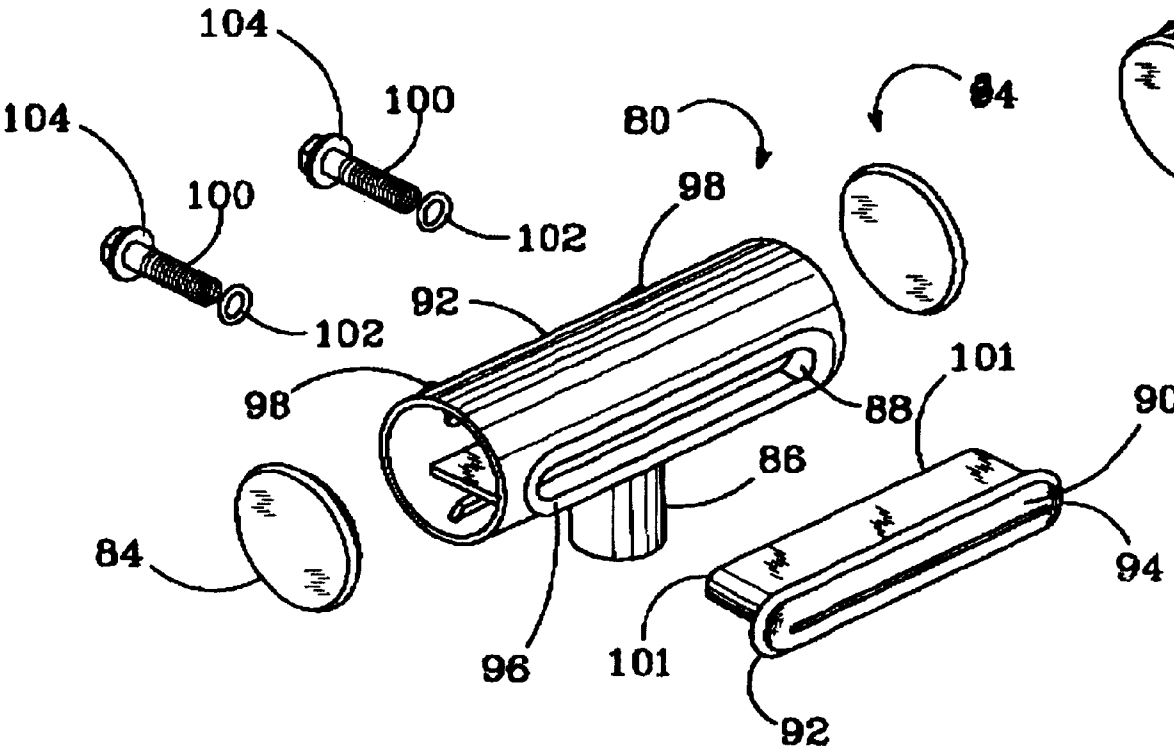
FIG. 8 is an exploded view of the spa apparatus shown in FIG. 7.

FIGS. 7 through 9 show another embodiment of a waterfall apparatus 80 that is particularly applicable to spas. It comprises a tubular body 82 with a circular plate 84 affixed at each end to provide a watertight seal, thereby enclosing the body's open ends. The body 82 has water inlet 86 that is directed vertically downward to receive a water supply tube from the spa's plumbing system. It also has a water outlet in the form of a horizontal slot 88 along most of its width. When the apparatus 80 is installed in a spa, its slot 88 is directed toward the interior of the spa.

The slot 88 is designed to receive an outlet cap 90. The cap slides into the slot 88 and a gasket 92 that is seated between the cap's lip 94 and the slot's perimeter 96. Two holes 98 are provided opposite the longitudinal slot for screws 100 pass through the holes and mate with threaded holes 101 in the rear of the outlet cap. O-rings 102 are seated between the head of each screw 100 and the surface of the body around each hole 101. Tightening the screws 100 seats the outlet cap 90 within the slot 88, and the gasket 92 forms a water tight seals between the cap 90 and the body 82. The O-rings 102 form water tight seals between their respective screw heads and the body 82.

FIG. 9 is a cross-section of the spa waterfall apparatus 80. The water supply pipe from the spa's plumbing is seated within the water inlet 86 and sealed with an adhesive. Relatively turbulent water flows from the plumbing into the tubular body 80 through the inlet 86. Longitudinal baffles 106 and 107 are positioned to remove most of the turbulence. Water entering the tubular body 80 is directed around the angled baffle 106 and through the space between its end and horizontal baffle 107, removing much of the turbulence. The water then flows around horizontal baffle 107, and between its end and the body's inner surface 108, removing much of the remaining turbulence. The water then flows back toward the longitudinal slot 88 and through the outlet cap 90, providing a waterfall to the interior of the spa.

Like the previous embodiments, the outlet cap 90 can be removed and replaced if a different type of waterfall is desired. It can also be removed to clear trapped debris, and it replaced if it is damaged. This is accomplished by simply removing the screws 100 from the cap's threaded holes 101 and sliding the cap 90 out of the slot 88. The same or a new outlet cap 90 can be replaced by sliding it back into the slot 88 and tightening the screws 100 within the cap's threaded holes 101, with the gasket 92 and O-rings 102 positioned properly.

Figure 10:
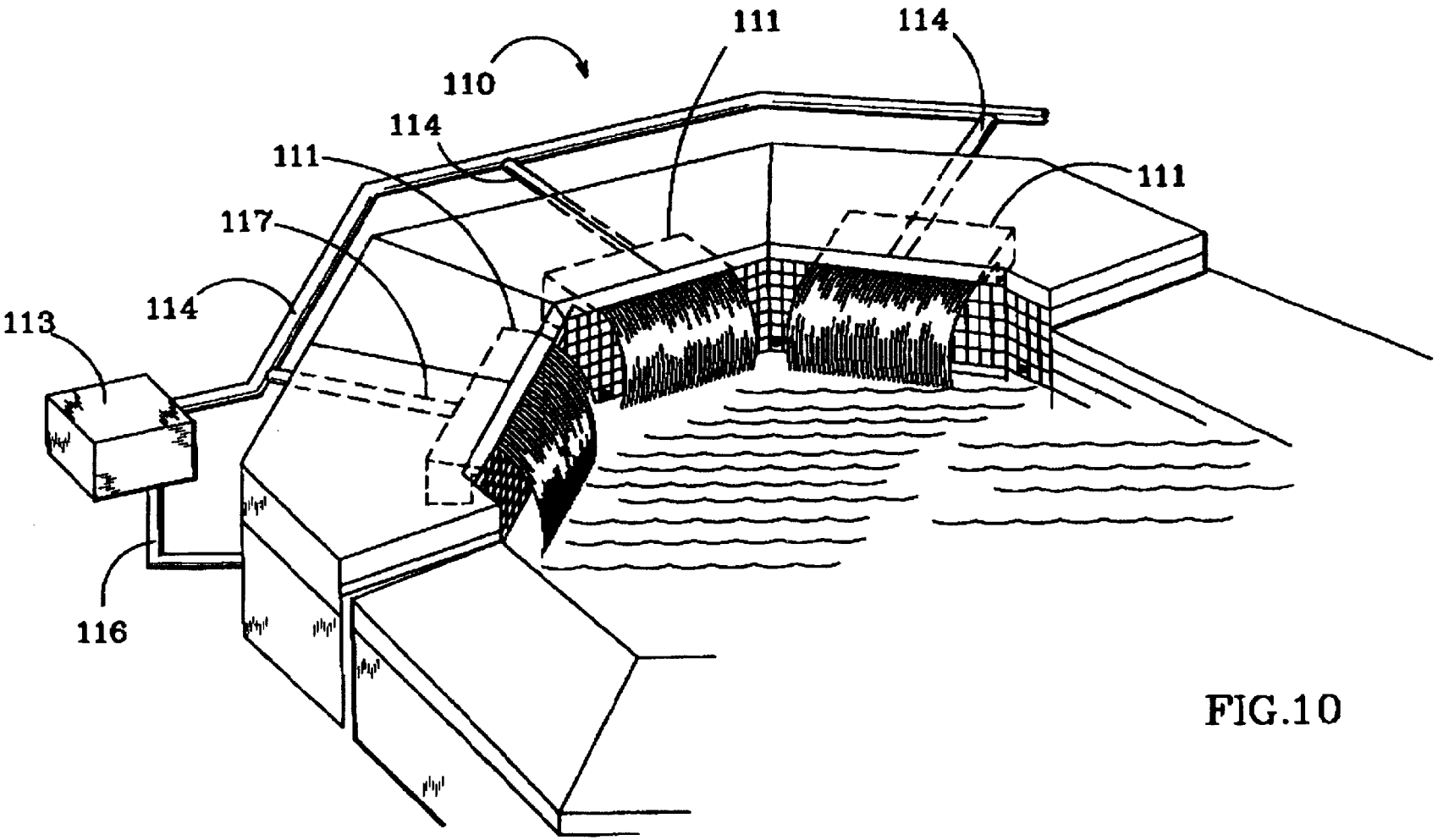
FIG. 10 is a perspective view of a pool/spa system using the new waterfall apparatus.

As shown in FIG. 10, multiple waterfall units can be installed in a pool/spa 110 in various locations. The waterfall units 111 are connected to a water pump 113 that circulates water throughout the pool or spa by a series of water conduits 114. Water flows from the pool/spa to the pump system 113 by a return water conduit 116. Conduits 114 are affixed to the inlets 117 of the respective waterfall units 111. Water flows into units and from the units into the pool/spa 110, completing the loop.

Although the present invention has been described in considerable detail with reference to certain preferred configurations, other versions are possible. Therefore, the spirit and scope of the appended claims should not be limited to the preferred versions described above.

We claim:

1. An apparatus for producing a waterfall, comprising:

a manifold body;

a water inlet into said body;

baffling structures internal to said body to remove turbulence from water entering said body;

an elongated water outlet arranged to pass water out of said body; and an elongated removable outlet cap on said outlet to form the water flowing from said outlet into a waterfall.

2. The apparatus of claim 1, wherein said cap is mounted on said outlet by at least one screw.

3. The apparatus of claim 1, wherein said manifold body is elongated and said outlet comprises a slender spillway projecting from the opposite side of said body from said water inlet.

4. The apparatus of claim 3, wherein said spillway further comprises a through slot that allows water to flow from said manifold and out said spillway.

5. The apparatus of claim 1, particularly applicable to spas, wherein said body is tubular shaped and said outlet comprises a longitudinal slot in said tubular body.

6. The apparatus of claim 1, further comprising a reservoir of water and a plumbing system having a water supply, wherein said outlet supplies a waterfall to said reservoir of water, said water inlet connected to said water supply from said reservoir's plumbing system and said waterfall is directed in toward the interior of said reservoir.

7. The apparatus of claim 1, wherein said outlet cap produces a waterfall in the form of a laminar sheet or raindrops.

8. The apparatus of claim 1, wherein said outlet cap produces a raindrop waterfall, said cap having a rear and a front and a slot that is widest at said rear and tapers to its narrowest at said front, said cap further comprising a series of holes along the front of said of said slot that discharge water from said slot as a flow of water drops.

9. The apparatus of claim 1, wherein said outlet cap produces a laminar sheet waterfall, said cap having a rear and a front and a through slot that is widest at said rear and tapers to its narrowest at said front.

10. An apparatus for producing a waterfall, comprising:

a manifold body;

a water inlet to into said body;

a water outlet arranged to pass water out of said body; and a removable outlet cap on said outlet to form the water flowing from said outlet into a waterfall, wherein said outlet cap produces a waterfall consisting of a combination of the waterfalls from the group consisting of a laminar sheet, a raindrop, an arc, a double arc, a fountain, and a pulsating waterfall, wherein said outlet cap further comprises a longitudinal ramp at said cap's front end, starting from below said slot, and directed up and away from said slot, such that water flowing from said cap is directed up and over said ramp to provide a spacing between said waterfall and the front of said cap.

11. A waterfall system, comprising:

a reservoir capable of holding water;

one or more waterfall units on the edge of said reservoir, each said waterfall unit having a water inlet connected to said pump system and a water outlet;

a water pump system that circulates water from said reservoir to said waterfall units; and a removable outlet cap on said outlet to form the water flowing from said outlet into a waterfall, wherein said outlet cap further comprises a longitudinal ramp at said cap's front end, starting from below said slot, and directed up and away from said slot, such that said water flowing from said cap is directed over said ramp to provide a spacing between said waterfall and said cap's front surface.

12. A waterfall system, comprising:

a reservoir capable of holding water;

one or more waterfall units on the edge of said reservoir, each said waterfall unit comprising:

a manifold body;

a water inlet into said body;

baffling structures internal to said body to remove turbulence from water entering said body;

an elongated water outlet arranged to pass water out of said body; and an elongated removable outlet cap on said outlet to form the water flowing from said outlet into a waterfall; and a water pump system that circulates water from said reservoir to said waterfall units, said pump system connected to said water inlet of said waterfall units.

13. The system of claim 12, wherein said outlet is produces a raindrop waterfall, said cap having a rear and a front and a slot that is widest at said rear and tapers to its narrowest at said front, said cap further comprising a series of holes along the front of said slot that discharge the from said slot as a flow of water drops.

14. The system of claim 12, wherein each said waterfall unit further comprises one or more internal baffles to remove turbulence from water flowing through said manifold body.

15. The system of claim 12, wherein said apparatus supplies a waterfall to said reservoir of water, said waterfall directed in toward the interior of said reservoir.

16. The system of claim 12, wherein said outlet cap produces a waterfall in the form of a laminar sheet or raindrops.

17. The system of claim 15, wherein said cap is mounted on said outlet by at least one screw.

18. The system of claim 12, wherein said outlet cap produces a laminar sheet waterfall, said cap having a rear and a front and a through slot that is widest at said rear and tapers to its narrowest at said front.

* * * * *